United States Patent [19]

Herment et al.

[11] 3,966,427

[45] June 29, 1976

[54] PRODUCTION OF BRIQUETTES

[75] Inventors: Robert Herment, Grand-Couronne; Yves Lafage, Paris; Jean Claude Emo; Jean Marie Yurcek, both of Grand-Couronne, all of France

[73] Assignee: Shell Oil Company, Houston, Tex.

[22] Filed: Jan. 17, 1975

[21] Appl. No.: 542,134

[30] Foreign Application Priority Data

Jan. 18, 1974 France ..... 74.01758

[52] U.S. Cl. ..... 44/10 H; 44/19; 44/23; 75/3; 423/170

[51] Int. Cl.[2] ..... C10L 5/00; C10L 5/16; C22B 1/08

[58] Field of Search ..... 44/19, 23, 10 H; 423/159, 170, 168; 75/3

[56] References Cited

UNITED STATES PATENTS

| | | | |
|---|---|---|---|
| 1,825,756 | 10/1931 | Reynard | 44/19 |
| 2,442,120 | 5/1948 | Duke | 423/170 |
| 2,618,537 | 11/1952 | Rabu | 44/23 |
| 3,041,161 | 6/1962 | Heinz et al. | 75/3 |
| 3,307,927 | 3/1967 | Muschenborn et al. | 44/19 |

*Primary Examiner*—Carl F. Dees

[57] ABSTRACT

A process for producing briquettes from wet cakes or muds containing mineral ore, including coal particles, characterized in that a wet cake or a mud is mixed with a bituminous binder selected from the group consisting of powdered bitumen, molten bitumen and a bitumen emulsion, whereafter the resltant mixture is compressed into briquettes at a temperature which is at least equal to about the Ring and Ball temperature minus 40°C of the bitumen present in the binder, after which optionally the briquettes are dried.

8 Claims, No Drawings

PRODUCTION OF BRIQUETTES

BACKGROUND OF THE INVENTION

The invention relates to the manufacture of briquettes from wet mineral ore, including coal particles.

It is known that dry pulverized ore can be pelletized with the aid of a bitumen emulsion. This is a useful method for the recovery of mineral ore dust which otherwise would be difficult to handle. However, this method has the disadvantage that the pellets produced have a low density and a low crushing strength, and therefore it is often difficult to subject the resultant pellets to further treatment. The obvious way to obtain agglomerates having a higher density and a better crushing strength would be to process the ore into briquettes instead of pellets.

This method, however, has two drawbacks. In the first place, the briquetting is not possible with ore that is present in the form of a wet cake originating, for example, from flotation processes or other separation processes in a wet medium, (for example, gravity separation of coal from stones in water) or with muds originating from scrubbing the fumes from steel converters. When treating these wet cakes or muds with an aqueous bitumen emulsion, agglomeration is difficult with muds and cakes having a high water content. In the second place, when using briquetting presses having tangential rolls for compressing the continuous feed of agglomerates into briquettes, the latter will not leave the machine owing to clogging of the cells of the rolls.

SUMMARY OF THE INVENTION

It has now been found that a bituminous binder selected from the group consisting of powdered bitumen, molten bitumen and a bitumen emulsion can be used for making briquettes from wet cakes or muds containing mineral ore, including coal particles, by agglomeration followed by pressing.

This, the invention relates to a process for producing briquettes comprising admixing water-containing solid particles or a sludge of said particles in a mixer with a bituminous binder selected from the group consisting of powdered bitumen, molten bitumen and bitumen emulsion, then subsequently compressing the resultant mixture directly after mixing, without separation of a substantial amount of liquid water from the mixer, into briquettes at a temperature which is at least equal to about the Ring and Ball temperature minus 40°C of the bitumen present in the bituminous binder, the amount of the binder being such that the briquettes contain from about 1 to about 12% by weight of said binder.

DESCRIPTION OF THE PREFERRED EMBODIMENTS

In order to obtain very hard raw briquettes and to avoid clogging of the cells or the manufacture of raw briquettes which are fragile and break at the slightest handling upon leaving the press, it is preferred to observe the three following conditions simultaneously:

1. the bituminous binder must be sufficiently dispersed in the minerals, for example, by improving the dispersion by mixing of the pasty mixture at a sufficiently high temperature.

2. the compression temperature of the pasty mixture must at least equal or preferably exceed the Ring and Ball temperature minus 40°C of the bitumen present.

3. the water content of the pastry mixture must be lower than a limiting value according to the type of product and in particular to its grain size distribution and its open porosity.

The finer are the products to be agglomerated, the higher the limiting value will be.

The water content of the wet cakes depends on the nature of the pasty mixture. For the floating mineral ores which frequently occur in the mining industry the water content of the mineral ore corresponds to the water content of the filtration cake on a rotary vacuo filter, viz. 5–15%. Similarly, muds originating from scrubbing steel works fumes have a water content which varies from 7 to 17%. On the other hand, for non-porous unfinished products, such as bloom scale, the water content varies from 1 to 4%, while for particularly fine products such as 100–500 A carbon black, the water content of the products may vary from 25 to 40%. For soot forming a by-product in the gasification of petroleum, the water content may vary between 65 and 80% by weight.

Generally, an improvement in the quality of the agglomerates thus prepared is obtained if the following preferred condition is observed. Before pressing, the pasty mixture is raised to the highest possible temperature. A very good agglomerate quality is obtained by effecting the admixture at or by raising the pasty mixture to a temperature below about 100°C and in excess of the Ring and Ball temperature plus 10°C of the bitumen present.

Optionally, the briquettes are subjected to a thermal treatment in an oxidizing, neutral or reducing atmosphere so that the temperature at the core of the briquettes is in the range of from about 101° to about 350°C for between about 1 minute and about 24 hours; the treatment is preferably carried out in an oxidizing atmosphere in such a way that the temperature at the core of the briquettes is in the range of from about 230° to about 300°C, preferably for between about 20 minutes and about 2 hours.

The object of this optional treatment is to completely dry the briquette and, if the briquette is raised to beyond about 230°C, to oxidize the bitumen and to harden it. Three consequences follow for the quality of the briquette: the mechanical qualities of the treated briquette (crushing strength, resistance to abrasion) depend little on the temperature and only to 400°–500°C; the tar content of the treated briquette can be made as low as desired in dependence on the temperature and the duration of treatment; and the content of bitumen carbon residue contained in the treated briquette is increased, thus ensuring a better mechanical behavior of the agglomerate at temperatures in excess of 500°C.

The optional thermal treatment of the briquettes is preferably carried out without submitting them to mechanical constraint. Thermal treatments in a furnace (tunnel oven) or in a basket is therefore preferred. The energy required for the thermal treatment may be supplied by a gas (for example, flue gas diluted with air) or a fluidized bed. If required, oxygen accelerators can be added, for example, phosphorus pentoxide, phosphoric acid, phosphoric acid salts which decompose at temperatures in excess of 300°C, organic phosphorus derivatives, Lewis acids, or compounds which decompose while giving off oxygen, such as, for example, the peroxides or perchlorates.

The bituminous binder useful in the process of the invention is a powdered bitumen, a molten bitumen, or a bitumen emulsion. When employing the emulsion form, any commercial bitumen emulsion can be used. Particularly emulsions having little or moderate stability can be used if they are added to products having a high water content, such as muds leaving a thickening device or floating ores before filtration on a rotary vacuo filter. If the product to be agglomerated has a moderate or low water content a stable or very stable emulsion is preferred. The emulsions may be cationic, anionic or non-ionic, the anionic emulsions being preferred to cationic emulsions to prevent corrosion of the collars of the briquetting press. The bitumen concentration of the emulsions may vary between about 20 and about 75%, a content between 40 and about 60% being preferred.

The anionic emulsifiers used may be soaps or surfactants such as wood resins neutralized by a base, preferably petroleum hydrocarbon-insoluble pinewood resin, available commercially as Vinsol resin (Vinsol is a trade mark), neutralized by potassium or sodium. Macromolecular emulsifiers, such as certain proteins, gum, starch and derivatives thereof (dextrin, methyl cellulose, lignosulfite) are also used. The non-ionic surfactants can also be used together with anionic or macromolecular emulsifiers, the non-ionic emulsifiers of the oxy-ethylenized condensate type being preferred. The anionic emulsions can also be stabilized by fine particles such as bentonite.

The emulsion to be used in the agglomeration can itself be prepared without chemical products, use simply being made of particles of the product to be agglomerated for stabilizing the bitumen particles in water.

Thus, a mixture of 66% of steelworks muds containing 50% of solid matter and 34% of 180/220 bitumen hot-poured (140°C) into the liquid muds heated to 60°C, forms a sufficiently stable emulsion for use in the agglomeration of steelworks mud. It is also possible to produce an emulsion in situ, by pouring for example 4% of 180/220 bitumen heated to 140°C on to the filtration cake of the steelworks muds heated to 60°C. The water content of the cake is 35%, its natural pH is 9.5. Some of the water contained in the mixture is subsequently evaporated and the mixture briquetted.

A comparison of the results obtained with different emulsions for the agglomeration of LD (Linz-Donau process) steelworks muds is given in Example 5 below.

The emulsion bitumen may have a penetration of 0–600 dmm at 25°C. If required, it may also be fluidized by an oil or a solvent. It can be obtained by direct distillation, semi-blowing, blowing, cracking or precipitation in propane or butane.

The bitumen binder content of the briquette varies from about 1 to about 12% by weight. The amount of bituminous binder used is preferably such that the briquettes contain a bitumen content of about 3% to about 5% by weight.

EXAMPLE 1

The effect of the emulsion dispersion

A. A 180/220 bitumen emulsion (Ring and Ball temperature 43°C) containing 42% of bitumen, 10 kg/ton of petroleum hydrocarbon-insoluble pinewood resin (Vinosol resin) and 5 kg/ton of pure NaOH which has a breaking index in the LCPC (Laboratoire Central des Ponts et Chaussees) cement test of 140 g, is dispersed excellently at ambient temperature in a barite containing 6% of water and yields briquettes which after a thermal oxidizing treatment at 250°C have a resistance of 70 kg with 3% of bitumen and of 80 kg with 4% of bitumen.

B. A 180/220 bitumen emulsion (Ring and Ball temperature 43°C) containing 50% of bitumen, 10 kg/ton of petroleum hydrocarbon-insoluble pinewood resin (Vinsol resin) and 2 kg/ton of pure NaOH which has a breaking index in the LCPC cement test of 40 g, is dispersed poorly in a barite and the press becomes completely clogged. The same mixture is subsequently heated to 45°C, the dispersion improves and the preparation of briquettes becomes possible. Their resistance after thermal oxidizing treatment at 250°C is 190 kg for 3% of bitumen.

C. The emulsion of Example 1 (B) is added to a barite first heated to 40°C. In this instance the emulsion breaks too rapidly to permit good dispersion of the bitumen in the mineral ore. The voids of the press do not become clogged but all the crude briquettes break upon leaving the press.

EXAMPLE 2

The relation between the Ring and Ball temperature of the bitumen and the pressing temperature:

A. The pasty mixture heated to 45°C of Example 1 (B) is cooled to 5°C and pressed at 5°C or a temperature equal to the Ring and Ball temperature minus 38°C. Good crude briquettes are obtained which, after thermal oxidizing treatment at 250°C, have a resistance of 200 kg. When the same procedure is carried out at +1°C it is not possible to produce crude briquettes (many broken briquettes).

B. A 100/1 bitumen emulsion (Ring and Ball temperature 100°C, penetration 1 dmm) is mixed in the cold state with a barite. The mixture is supplied at various temperatures and pressed.

Table I

| Pressing Temperature | Crude Briquettes obtained | Resistance of dried briquette (Kg) 3% of bitumen | Resistance of oxidized briquette (Kg) 3% of bitumen |
|---|---|---|---|
| 15°C | no | | |
| 50°C | no | | |
| 60°C | yes | 47 | 164 |
| 75°C | yes | 78 | 232 |

EXAMPLE 3

The effect of the water content

A. 6% of a 180/220 bitumen emulsion containing 50% of bitumen is added to a barite having a water content of 6 %. The water content of the pasty mixture is 9.0% and the mixture is formed into good crude briquettes. The procedure is resumed by bringing the water content of the barite to 9%. The water content of the pasty mixture is 12% and complete clogging of the collar cells then occurs.

B. 6% of a 180/220 bitumen emulsion containing 50% of bitumen is added to a mud originating from scrubbing the fumes from LD steel converters. The water content of the pasty mixture is 17% and it is formed into good raw briquettes. The procedure is resumed by bringing the water content of the mud to 15%. The water content of the pasty mixture is 18% and complete clogging of the collar cells occurs.

EXAMPLE 4

The effect of heating the mixture

The quality of the pasty mixture is improved by heating it to the highest possible temperature.

A. The emulsion of Example 1 (B), which has the same composition as the present one, is mixed at ambient temperature with a barite and the mixture is heated to various temperatures. The Ring and Ball temperature of the bitumen used is 38°C.

Table II

| Temperature | Resistance of the briquettes after oxidation at 250°C (3% of bitumen) |
|---|---|
| 40°C | 134 kg |
| 45°C | 183 kg |
| 48°C | 235 kg |

B. A 20/30 bitumen emulsion containing 42% of bitumen is mixed at ambient temperature (18°C) with barite. In another run, this mixture is heated to 65°C or to a temperature equal to the Ring and Ball Temperature plus 10°C.

The results are as follows:

Table III

| Temperature | Resistance of the briquettes after oxidation at 250°C (3% of bitumen) |
|---|---|
| 18°C | 70 kg |
| 65°C | 240 kg |

EXAMPLE 5

A comparison of the various 180/220 bitumen emulsion formulations for agglomeration of LD steelworks muds All the runs relate to bitumen 180/220 contents of 4% based on dry muds.

Run 1. The emulsion of Example 1 (B) is dispersed at 15°C into muds containing 12% of water. Mixing and pressing are effected at 15°C.

Run 2. The same experiment but the mixture is heated to 60°C.

Run 3. An emulsion of 10 kg/ton of caseine, 2 kg/ton of KOH is used as in Run 1.

Run 4. An emulsion produced with 66% of mud containing 50% of water and 33% of bitumen is used as in Run 1.

Run 5. The 180/220 bitumen of 140°C is added to the mud containing 35% of water, heated to 60°C. The mixture is heated to 60°C to reduce its water content to 13%.

Table IV

| Run No. | 1 | 2 | 3 | 4 | 5 |
|---|---|---|---|---|---|
| Resistance of the dried briquettes (kg) | 7 | 21 | 15 | 9 | 18 |
| Resistance of the oxidized briquettes (kg) | 20 | 62 | 43 | 34 | 59 |

EXAMPLE 6

The effect of duration and temperature of the thermal oxidizing treatment

A. Barite is agglomerated with 6% of 20/30 bitumen emulsion.

Table V

| Resistance of the dry briquettes: 40 kg | measured at 15°C | measured at 200°C |
|---|---|---|
| Resistance of the oxidized briquettes in a tunnel oven | | |
| 250°C 20 minutes | 85 kg | 10 kg |
| 250°C 30 minutes | 98 kg | 28 kg |
| 250°C 40 minutes | 117 kg | 43 kg |
| 250°C 70 minutes | 135 kg | 90 kg |
| in a fluidized bed | | |
| 250°C 30 minutes | 35 kg | 1 kg |
| 250°C 40 minutes | 63 kg | 2.5 kg |
| 280°C 30 minutes | 88 kg | 24 kg |
| 280°C 40 minutes | 90 kg | 48 kg |
| 320°C 30 minutes | 73 kg | 11 kg |
| 320°C 40 minutes | 81 kg | 37 kg |

(B) Briquettes of muds from an oxygen steel plant (Kaldo) agglomerated with 4% of bitumen in the form of an emulsion are treated in an oven.

Table VI

| Resistance of the oxidized briquettes at | | measured at 15°C |
|---|---|---|
| 210°C | 70 minutes | 18 kg |
| | 90 minutes | 22 kg |
| 230°C | 70 minutes | 56 kg |
| | 90 minutes | 82 kg |
| 250°C | 70 minutes | 86 kg |
| | 90 minutes | 83 kg |
| 270°C | 70 minutes | 63 kg |
| | 90 minutes | 55 kg |

EXAMPLE 7

The thermal treatment reduces the tar content of the briquette and increases the Conradson bitumen residue The briquettes of Example 6 (A) are treated at 250°C, 280°C and 320°C.

Table VII

| | Tar content (% based on binder) | Conradson carbon content (% based on binder) |
|---|---|---|
| Dried briquettes | 50.0 | 37.3 |
| Briquettes oxidized at | | |
| 250°C 30 minutes | 27.5 | 48.7 |
| 250°C 90 minutes | 13.5 | 54.0 |
| 280°C 30 minutes | 8.0 | 57.0 |
| 280°C 90 minutes | 0.5 | 55.3 |
| 320°C 30 minutes | 5.5 | 56.0 |
| 320°C 90 minutes | 0 | 49.7 |

What is claimed is:

1. A process for producing briquettes comprising admixing water-containing solid particles selected from the class consisting of mineral ore, coal and carbonaceous soot or a mud of said particles in a mixer with a bituminous binder selected from the group consisting of powdered bitumen, molten bitumen and bitumen emulsion, and then subsequently compressing the resultant mixture directly after mixing, without separation of a substantial amount of liquid water from the mixer, into briquettes at a temperature which is at least equal to about the softening point temperature, as measured by the Ring and Ball method, minus 40°C of the bitumen present in the bituminous binder, the amount of the binder being such that the briquettes contain from about 1 to about 12% by weight of said binder.

2. The process of claim 1 wherein said admixing is effected at a temperature such that the temperature of the bulk mixture subsequent to admixing is below about 100°C and in excess of the softening point temperature as measured by the Ring and Ball method plus 10°C of the bitumen present in said bituminous binder.

3. The process of claim 1 wherein the briquettes produced contain a bitumen content of about 3% to about 5% by weight.

4. The process of claim 1 wherein said bituminous binder is a bitumen emulsion.

5. The process of claim 4 wherein the bitumen emulsion contains from about 40% to about 60% by weight of bitumen.

6. The process of claim 4 wherein said emulsion contains a bitumen having a penetration of 0–600 dmm at 25°C.

7. The process of claim 4 wherein said emulsion is an anionic bitumen emulsion.

8. The process of claim 7 wherein the emulsifier in the bitumen emulsion is a petroleum hydrocarbon-insoluble pinewood resin salt.

* * * * *